US012529547B1

(12) United States Patent
Harms

(10) Patent No.: US 12,529,547 B1
(45) Date of Patent: Jan. 20, 2026

(54) PRELOAD CABLE, DETONATOR CABLE ASSEMBLY, AND METHODS OF MAKING THE SAME

(71) Applicant: Honeywell Federal Manufacturing & Technologies, LLC, Kansas City, MO (US)

(72) Inventor: Douglas Harold Harms, Blue Springs, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 1279 days.

(21) Appl. No.: 17/084,839

(22) Filed: Oct. 30, 2020

Related U.S. Application Data

(60) Provisional application No. 62/928,106, filed on Oct. 30, 2019.

(51) Int. Cl.
*F42B 3/198* (2006.01)

(52) U.S. Cl.
CPC ..... *F42B 3/198* (2013.01)

(58) Field of Classification Search
CPC ..... F42B 3/124; F42B 3/125; F42B 3/127; F42B 3/13; F42B 3/198
USPC ..... 102/202.5, 202.6, 202.7, 202.8, 202.9, 102/202.11, 202.12, 202.13, 202.14
See application file for complete search history.

(56) References Cited

U.S. PATENT DOCUMENTS

| | | | | |
|---|---|---|---|---|
| 4,959,119 | A | 9/1990 | Lantzer | |
| 5,385,097 | A * | 1/1995 | Hruska | F42C 19/12 102/202.1 |
| 6,130,015 | A | 10/2000 | Noddin et al. | |
| 6,324,979 | B1 * | 12/2001 | Troianello | F42B 3/124 102/202.7 |
| 6,467,414 | B1 * | 10/2002 | Fisher | H05K 1/026 102/202.3 |
| 8,276,516 | B1 | 10/2012 | Nance et al. | |
| 8,573,122 | B1 * | 11/2013 | Nance | F42B 3/12 102/202.7 |
| 8,746,144 | B2 | 6/2014 | Givens et al. | |
| 9,347,755 | B2 | 5/2016 | Backhus et al. | |
| 2019/0353467 | A1 * | 11/2019 | West | F42B 3/12 |

FOREIGN PATENT DOCUMENTS

DE 10116189 A1 * 10/2002 ..... F42B 3/124

OTHER PUBLICATIONS

Mike Bowden, The Development of a Laser Detonator System, Defence College of Management and Technology, Cranfield University, 2014.

* cited by examiner

*Primary Examiner* — Bret Hayes
(74) *Attorney, Agent, or Firm* — Hovey Williams LLP

(57) ABSTRACT

A preload cable comprises a cable, a first substrate, a bridge, a flyer, and a second substrate. The cable includes a pair of contacts. The first substrate includes a pair of conductors connected to the contacts. The bridge is positioned on the first substrate and is connected to the conductors. The flyer is positioned on the bridge. The second substrate is positioned adjacent to the first substrate and comprises a polyimide layer, and a hole extending through the polyimide layer and in alignment with the flyer.

17 Claims, 3 Drawing Sheets

PRELOAD CABLE, DETONATOR CABLE ASSEMBLY, AND METHODS OF MAKING THE SAME

RELATED APPLICATIONS

This application claims the benefit of U.S. Provisional Application Ser. No. 62/928,106, filed Oct. 30, 2019, entitled EXPLODING FOIL INITIATOR, the entire disclosure of which is hereby incorporated by reference herein.

STATEMENT REGARDING FEDERALLY-SPONSORED RESEARCH OR DEVELOPMENT

This invention was made with Government support under Contract No.: DE-NA-0002839 awarded by the United States Department of Energy National Nuclear Security Administration. The Government has certain rights in the invention.

BACKGROUND

An exploding foil initiator is a device used in detonation systems to initiate primary explosive material. It generally includes a base, a bridge, flyer material positioned on the base, material positioned above the base to form a barrel, a cap to house the exploding foil initiator, and two or more conductive traces. The base may be attached to the rest of a detonation system using wire bonds on a side, solder attachments on a back side, or via parallel gap welding. The solder attachments generally use plated, filled or unfilled vias and solders to attach the exploding foil initiator to the rest of the system. An electrical charge is injected into the bridge to create a small plasma explosion that propels the flyer through the barrel to the charge.

To ensure complete and consistent detonation, the flyer must achieve a high velocity and directly hit the explosive material. To accomplish such an impact, the thickness of the barrel must be consistent, as it determines the travel distance and ultimate velocity of the flyer on impact. The thickness also determines the timing of the detonation. Additionally, the exploding foil initiator must be compact so it can fit on the detonation system and efficiently utilize space. Existing barrels are often formed via injection molding using molds that impart cavities on the barrel material for fitting the bridge over the barrel in a compact manner. However, injection molding is prone to producing defects in the barrel. For example, the mold may not sufficiently align the barrel and cavity so that the flyer would not achieve the correct velocity. In fact, it has been found that such processes have successful production yields of less than 10%.

The background discussion is intended to provide information related to the present invention which is not necessarily prior art.

SUMMARY

The present invention solves the above-described problems and other problems by providing a preload cable with an improved barrel, a detonator cable assembly with an improved barrel, and a method of manufacturing the same. The manufacturing method is more precise, produces more consistent barrel dimensions, and results in a higher production yield.

A preload cable constructed in accordance with an embodiment of the present invention broadly comprises a cable, a first substrate, a bridge positioned on the first substrate, a flyer positioned on the bridge, and a second substrate positioned adjacent the first substrate. The cable includes a pair of contacts, and the first substrate includes a pair of conductors connected to the contacts. The bridge is connected to the conductors.

The second substrate comprises a polyimide layer, and a hole extending through the polyimide layer and in alignment with the flyer. The polyimide substrate provides a durable barrel that is both electrically and thermally resistant. Additionally, the inventor has found that a polyimide substrate formed by laminates with laser drilling to form the hole provides high production yields.

A detonator cable assembly constructed in accordance with an embodiment of the present invention broadly comprises the preload cable discussed above and further includes a charge comprising explosive material attached to the second substrate of the preload cable.

A method of forming a preload cable according to an embodiment of the present invention comprises forming a first substrate with one or more layers of polyimide; cutting a hole in the first substrate; ablating, via the laser, a portion of the first substrate to form a fiducial; aligning a second substrate using the fiducial of the first substrate, the second substrate including a bridge with a flyer positioned thereon; and attaching the second substrate to the first substrate so that the flyer is aligned with the hole of the first substrate.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
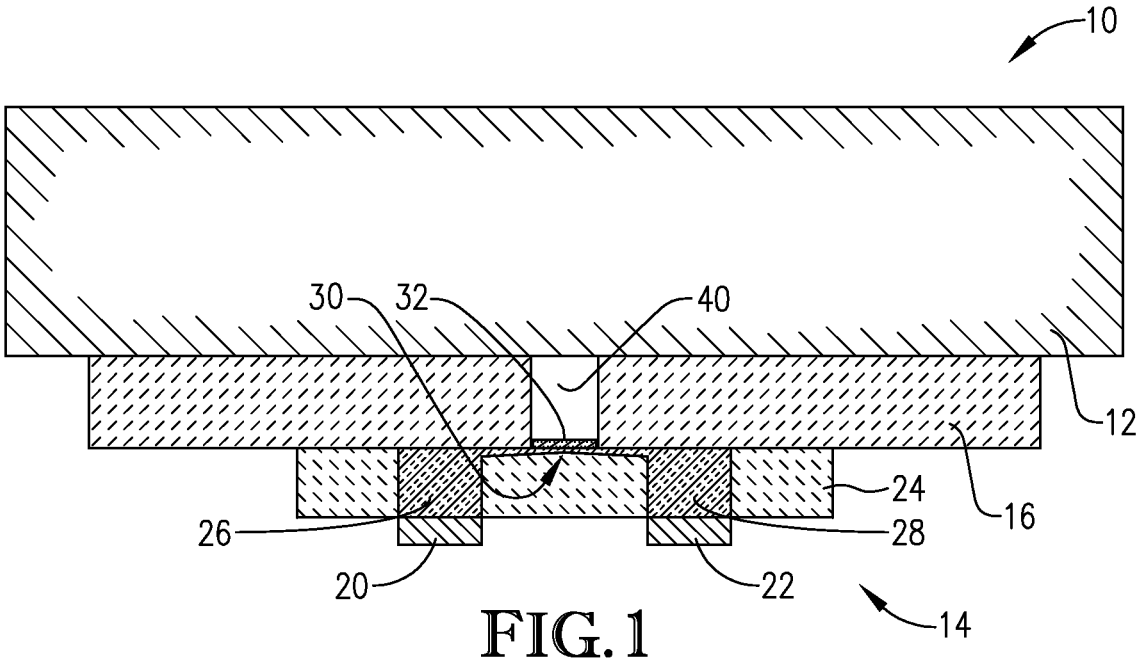
FIG. 1 is a cross-sectional view of a detonator cable assembly constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to FIG. 1, a detonator cable assembly 10 constructed in accordance with an embodiment of the present invention is illustrated. The detonator cable assembly 10 comprises a charge 12 and a preload cable 14 configured to detonate the charge 12. The charge 12 comprises explosive material and may be the main explosive component in a bomb, missile, mine, rocket, or the like, or may be a stage in such a device.

Figure 2:
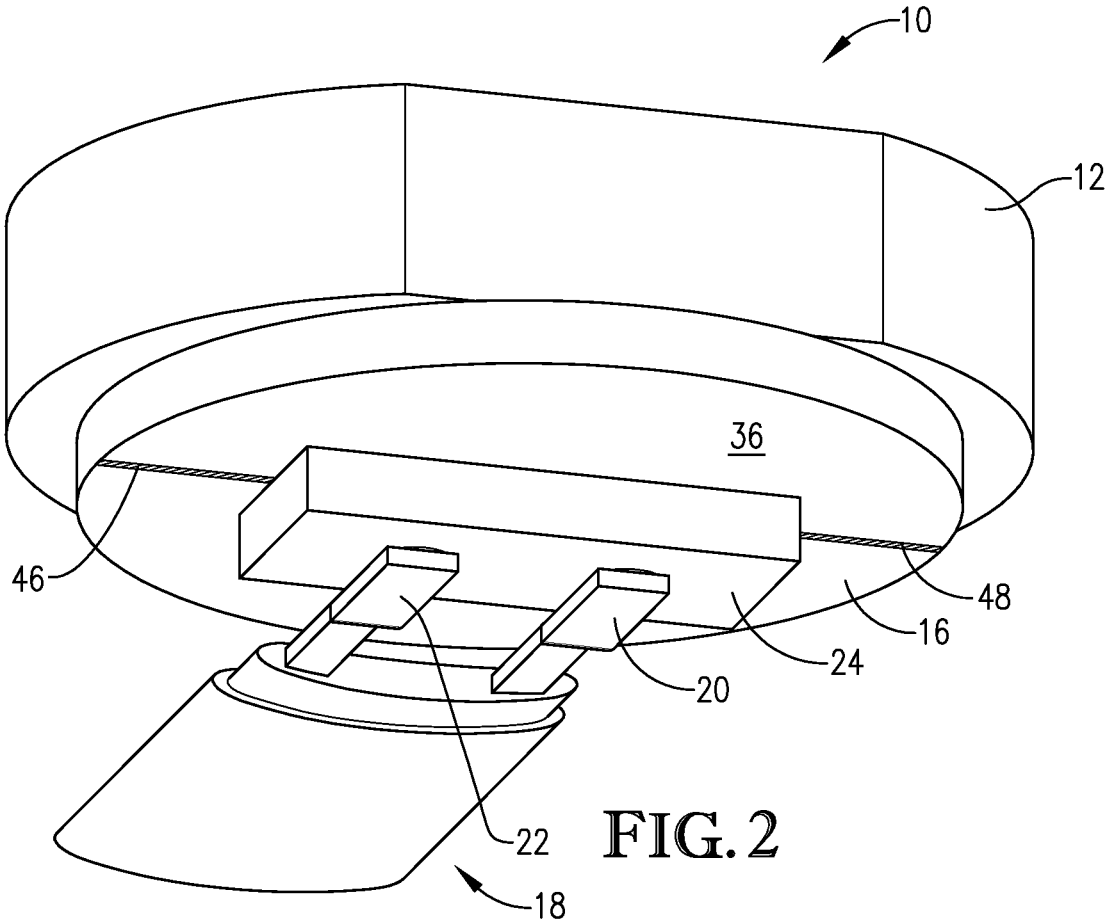
FIG. 2 is a lowered perspective view of the detonator cable assembly of FIG. 1.
Figure 3:
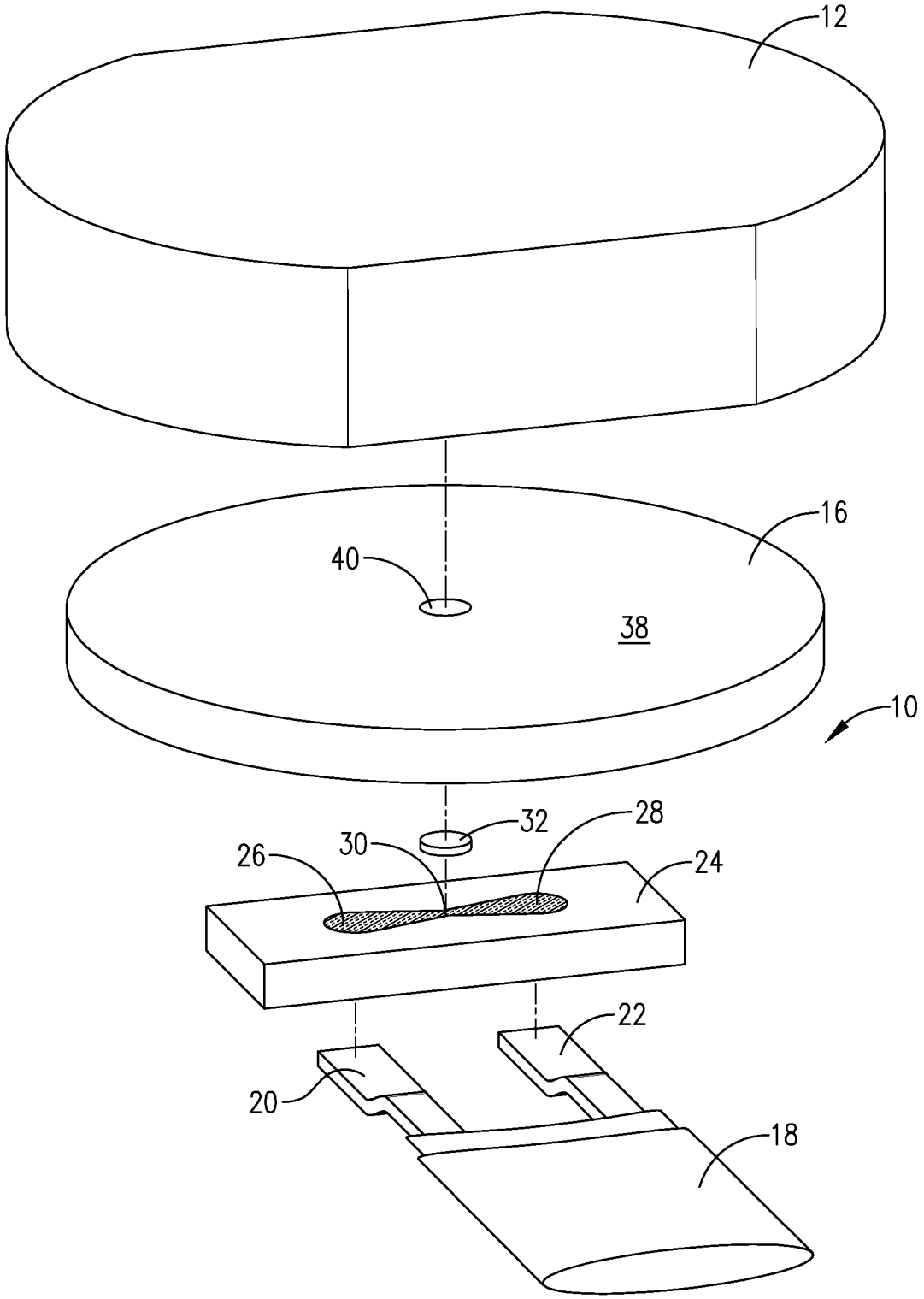
FIG. 3 is an exploded view of the detonator cable assembly of FIG. 1.
Figure 4:
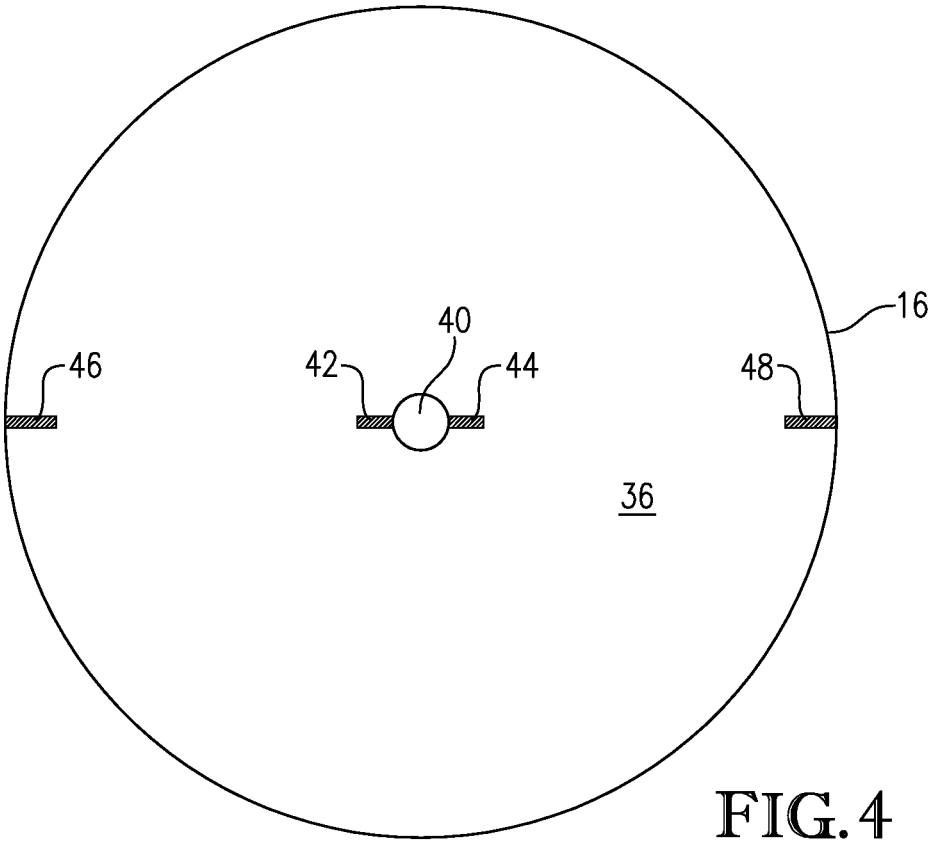
FIG. 4 is a plan view of a barrel of the detonator cable assembly of FIG. 1.

The preload cable 14 includes a substrate 16, a cable 18 (depicted in FIG. 2) having a pair of contacts 20, 22, a substrate 24 with a pair of conductors 26, 28 connected to the contacts 20, 22, a bridge 30 connected to the conductors 26, 28, and a flyer 32 positioned over the bridge 30. The laminated substrate 16 provides a durable barrel that is both electrically and thermally resistant. The substrate 16 comprises one or more polyimide sheets forming a first surface 36, a second surface 38, and a hole 40 extending orthogonally from the first surface 36 to the second surface 38. The hole 40 may extend through the center of the surfaces 36, 38 and is aligned with the flyer 32. The inventor has found that the polyimide substrate 16 formed by laminate sheets with laser drilling, or other methods of cutting and/or drilling, to form the hole 40 provides high production yields for consistent detonation of the charge 12.

In some embodiments, the substrate 16 further comprises fiducials 42, 44, 46, 48 formed on the first surface 36 of the substrate for aligning the substrate 24 when attaching it and substrate 16. The fiducials 42, 44 may extend radially outward from the hole 40, and fiducials 46, 48 may extend radially inward from the perimeter of the surface 36 and may be in alignment with corresponding fiducials 42, 44. In preferred embodiments, the fiducials 46, 48 are positioned slightly radially inward from the edges of the substrate 16 to improve the robustness of the substrate 16.

The cable 18 may be connected to a control system (not shown) that provides electric current to the cable 18 when the charge 12 is to be detonated. The cable 18 may comprise one or more conductors, such as metal wires, that conduct the electric current. The contacts 20, 22 transfer the electric current from the cable 18 to the conductors 26, 28 and may be soldered thereto.

The substrate 24 supports the conductors 26, 28 and the bridge 30 and may comprise a dielectric material that thermally and electrically insulates the components of the preload cable 14. The conductors 26, 28 extend from the contacts 20, 22, through the substrate 24, and are electrically connected to the bridge 30. The conductors 26, 28 comprise conductive material, such as filled metal vias and/or metal wires. The bridge 30 receives the electric current from the conductors 26, 28. The bridge 30 is physically relatively small enough so that the current from the conductors 26, 28 causes a plasma to be generated at the bridge 30, which causes a rapid expansion of air above the bridge 30. The bridge 30 may also comprise electrically conductive material, such as metal foil. The flyer 32 is positioned above the bridge 30 and is configured to be propelled by the expansion of air from the plasma generated by electric current traveling through the bridge 30.

An exemplary way to use the above-described system will now be described. When detonation is triggered, the cable 18 carries the electrical current to the contacts 20, 22, which transfer the current to the conductors 26, 28. The current travels through the conductors 26, 28 and through the bridge 30. The current traveling through the bridge 30 causes the bridge 30 to vaporize, forming a plasma, which propels the flyer 32 through the hole 40 of the substrate 16 toward the charge 12. The explosion propelling the flyer 32 is guided by the hole 40, and the flyer 32 impacts the charge 12, which then ignites.

Figure 5:
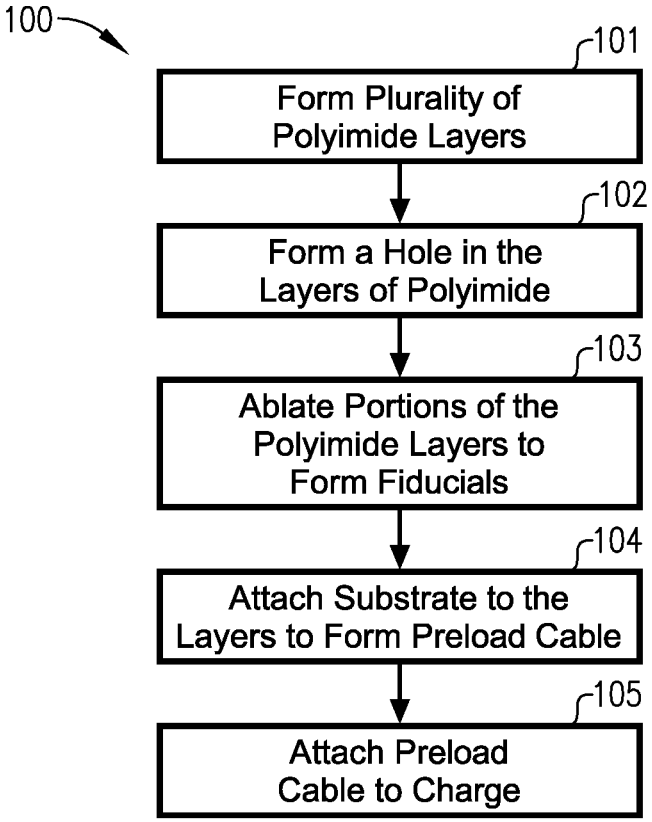
FIG. 5 is a flowchart illustrating a method of forming a detonator cable assembly according to an embodiment of the present invention.

The flow chart of FIG. 5 depicts the steps of an exemplary method 100 of manufacturing a preload cable and a detonator cable assembly. In some alternative implementations, the functions noted in the various blocks may occur out of the order depicted in FIG. 5. For example, two blocks shown in succession in FIG. 5 may in fact be executed substantially concurrently, or the blocks may sometimes be executed in the reverse order depending upon the functionality involved. In addition, some steps may be optional.

Referring to step 101, a plurality of layers of polyimide are formed. The plurality of layers may be formed by applying laminate sheets of polyimide to a substrate. The laminate sheets may be bonded together using an adhesive. In some embodiments, a thickness of the combined layers may be about 127 microns (0.005 inches) or up to about 508 microns (0.02 inches). In preferred embodiments, the thickness is about 355.6 microns (0.014 inches). The layers are formed so that their combined thickness is consistent, varying by only about 5%.

Referring to step 102, a hole may be cut in the plurality of layers of polyimide. The hole may be formed in the center of the polyimide layers. In preferred embodiments, a laser may be used to cut the hole. The hole is cut to extend completely through the polyimide layers, thereby forming a barrel. The laser may cut into the layers of polyimide at an angle substantially normal to a surface of the layers of polyimide and form the hole so that it extends orthogonally through the layers.

Referring to step 103, portions of the plurality of layers are ablated to form fiducials. The portions may be ablated using the laser. The fiducials may be formed on the surface of the barrel and extend radially outwards from the hole. Corresponding fiducials extending radially inward from a perimeter of the surface may also be formed. The corresponding fiducials may be formed so that they are in alignment with the fiducials around the hole.

Referring to step 104, a substrate having a flyer positioned thereon is attached to the plurality of layers so that the flyer is aligned with the hole of the plurality of layers, thereby forming a preload cable. The substrate may be aligned using the fiducials formed on the surface of the plurality of layers. The fiducials may be used as a reference to improve accuracy of the placement of the substrate. The substrate may include a pair of conductors electrically connected to a bridge upon which the flyer is disposed. The conductors may extend through the substrate and connect to a pair of conductors of a cable.

Referring to step 105, the preload cable is attached to a charge to form a detonator cable assembly. The charge may comprise explosive material and may be an initial stage in an explosive device, such as a bomb, missile, mine, rocket, or the like, or the charge may be a main charge of an explosive device.

The method 100 may include additional, less, or alternate steps and/or device(s), including those discussed elsewhere herein. For example, the exploding foil initiator assembly may then be attached to a charge with the surface of the polyimide layers opposite to the cable assembly is in contact to a surface of the charge.

Additional Considerations

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The various operations of example methods described herein may be performed, at least partially, by one or more processing elements that are temporarily configured (e.g., by software) or permanently configured to perform the relevant operations. Whether temporarily or permanently configured, such processing elements may constitute processing element-implemented modules that operate to perform one or more operations or functions. The modules referred to herein may, in some example embodiments, comprise processing element-implemented modules.

Similarly, the methods or routines described herein may be at least partially processing element-implemented. For example, at least some of the operations of a method may be performed by one or more processing elements or processing element-implemented hardware modules. The performance of certain of the operations may be distributed among the one or more processing elements, not only residing within a single machine, but deployed across a number of machines. In some example embodiments, the processing elements may be located in a single location (e.g., within a home environment, an office environment or as a server farm), while in other embodiments the processing elements may be distributed across a number of locations.

Unless specifically stated otherwise, discussions herein using words such as "processing," "computing," "calculating," "determining," "presenting," "displaying," or the like may refer to actions or processes of a machine (e.g., a computer with a processing element and other computer hardware components) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the invention has been described with reference to the embodiments illustrated in the attached drawing figures, it is noted that equivalents may be employed and substitutions made herein without departing from the scope of the invention as recited in the claims of any subsequent regular utility application.

The invention claimed is:

1. A preload cable comprising:
- a cable having a pair of contacts;
- a first substrate including a pair of conductors connected to the contacts;
- a bridge positioned on the first substrate and connected to the conductors;
- a flyer positioned on the bridge; and
- a second substrate positioned adjacent to the first substrate and comprising—
  - a polyimide layer, and
  - a hole extending through the polyimide layer and in alignment with the flyer,
- wherein the second substrate comprises a first surface that faces the first substrate and that includes a first fiducial formed thereon.

2. The preload cable of claim 1, wherein the first surface of the second substrate includes a second fiducial, the first fiducial and the second fiducial located on opposing sides of the hole of the second substrate.

3. The preload cable of claim 1, wherein the second substrate has a thickness of about 127 microns to about 508 microns.

4. The preload cable of claim 1, wherein the thickness of the second substrate is about 355.6 microns.

5. The preload cable of claim 1, wherein the first substrate includes a first surface on which the bridge is positioned and a second surface, the pair of conductors comprising conductive material disposed in unfilled vias to form filled vias extending from the first surface to the second surface, the contacts of the cable connected to the pair of conductors on the second surface.

6. A detonator cable assembly comprising:

a cable having a pair of contacts;

a first substrate including a pair of conductors connected to the contacts;

a bridge positioned on the first substrate and connected to the conductors;

a flyer positioned on the bridge;

a second substrate positioned adjacent the first substrate and comprising— a plurality of polyimide layers having a first surface adjacent the first substrate and a second surface opposite the first surface, and a hole extending from the first surface to the second surface and in alignment with the flyer; and a charge comprising explosive material positioned on the second surface of the second substrate, wherein the first surface of the second substrate includes a first fiducial formed thereon.

7. The detonator cable assembly of claim 6, wherein the first surface of the second substrate includes a second fiducial, the first fiducial and the second fiducial positioned on opposing sides of the hole of the second substrate.

8. A method of forming a preload cable, the method comprising:

forming a first substrate with one or more layers of polyimide;

cutting a hole in the first substrate;

ablating a portion of the first substrate to form a fiducial;

aligning a second substrate using the fiducial of the first substrate, the second substrate including a bridge with a flyer positioned thereon; and attaching the second substrate to the first substrate so that the flyer is aligned with the hole of the first substrate.

9. The method of claim 8, wherein the portion of the first substrate is a first portion and the fiducial is a first fiducial, further comprising ablating a second fiducial.

10. The method of claim 8, wherein the cutting step comprises cutting the hole via a laser.

11. The method of claim 8, wherein the ablating step comprises ablating the portion of the first substrate via a laser.

12. The method of claim 8, further comprising forming holes in the second substrate extending from the bridge to a surface of the second substrate opposite to the bridge.

13. The method of claim 12, further comprising filling the holes in the second substrate with conductive material to form filled vias.

14. The method of claim 13, further comprising connecting contacts of a cable to the filled vias on the surface of the second substrate opposite to the bridge.

15. The method of claim 8, wherein the forming step comprises stacking the one or more layers of polyimide until the first substrate has a thickness of about 127 microns to about 508 microns.

16. The method of claim 8, wherein the forming step comprises stacking the one or more layers of polyimide until the first substrate has a thickness of about 355.6 microns.

17. The method of claim 8, wherein the first substrate is formed with a thickness that varies by less than about 5%.

* * * * *